US006827213B2

(12) United States Patent
Hirotomi et al.

(10) Patent No.: US 6,827,213 B2
(45) Date of Patent: Dec. 7, 2004

(54) COSMETIC CONTAINER

(75) Inventors: Keiji Hirotomi, Chiba (JP); Kenichi Ito, Chiba (JP); Hideo Fujita, Chiba (JP); Hiroshi Yamazaki, Chiba (JP)

(73) Assignee: Hidan Co., Kashiwa (JP)

( * ) Notice: Subject to any disclaimer, the term of this patent is extended or adjusted under 35 U.S.C. 154(b) by 519 days.

(21) Appl. No.: 09/966,443

(22) Filed: Sep. 26, 2001

(65) Prior Publication Data

US 2002/0043270 A1 Apr. 18, 2002

(30) Foreign Application Priority Data

Oct. 12, 2000 (JP) ..... 2000-312607
Jun. 7, 2001 (JP) ..... 2001-172545

(51) Int. Cl.[7] ..... B65D 85/72
(52) U.S. Cl. ..... 206/385; 401/78; 401/80
(58) Field of Search ..... 206/385, 581; 132/297; 401/78, 80, 98, 68

(56) References Cited

U.S. PATENT DOCUMENTS 5,427,464 A 6/1995 Nakagawa
5,549,404 A 8/1996 Kageyama et al.
5,873,667 A * 2/1999 Inoue et al. ..... 401/78
5,984,554 A * 11/1999 Bouix ..... 401/98
6,070,725 A * 6/2000 Ito et al. ..... 206/385

OTHER PUBLICATIONS

Patent Abstracts of Japan, vol. 1996, No. 5, May 31, 1996 and JP 08–019421 A (Shiseido Co. Ltd.; Others: 01, Jan. 23, 1996—Abstract only.

* cited by examiner

*Primary Examiner*—John J. Wilson
*Assistant Examiner*—Robyn Kieu Doan
(74) *Attorney, Agent, or Firm*—Frishauf, Holtz, Goodman & Chick, P.C.

(57) ABSTRACT

A cosmetic container (10) comprises a housing assembly (1, 3, 4, 7, 9) with an annular projection (8) and a cap assembly (11, 12) with an inner cap member (12) engageable with the annular projection. The inner cap member has a wall portion (15) between upper and lower annular external swells (16, 17), which is deformed to provide air-tight engagement with the annular projection in a capped condition. The lower swell (16) comprises a plurality of spaced segmental annular projections (161) formed substantially around the outer surface of the inner cap member and one or more of dotty projections (162) positioned substantially within each space between adjacent two of the segmental annular projections. The lower swell acts as a first stopper for preventing removal of the cap assembly from the housing assembly, whereas the upper swell acts as a second stopper for preventing excessive insertion of the housing assembly into the cap assembly.

8 Claims, 18 Drawing Sheets

COSMETIC CONTAINER

BACKGROUND OF THE INVENTION

1. Field of the Invention

The present invention relates to a cosmetic container such as a lipstick container. More particularly, the present invention relates to a cosmetic container comprising a housing assembly and a cap assembly with an inner cap member fittable onto the housing assembly.

2. Description of the Prior Art

In the prior art cosmetic containers, the housing assembly includes an insert sleeve that is integrally fitted to the upper end portion of a rotatable outer body. The insert sleeve supports a stationary main body while allowing relative rotation therebetween. A cosmetic holder receiving a lipstick is vertically slidably accommodated in the main body. The upper portion of the insert sleeve has an annular projection which becomes fitted within a corresponding annular groove of the inner cap member, when the container is capped.

However, in some case, the annular projection of the insert sleeve is positioned at a level somewhat offset from the position of the annular groove of the inner cap member in the capped condition. This could result from displacement in assembling the inner cap member to an outer cap member.

Furthermore, formation of the annular groove on the inner cap member is practically difficult. When the annular groove do not satisfy a prescribed size requirement, the annular projection fails to be tightly engaged within the annular groove, thereby degrading air-tightness of the cosmetic container.

It is also important that the annular groove should be formed at definite location with respect to the annular projection of the insert sleeve in a capped condition. If the annular groove should be formed offset above the annular projection, the cap would become easy to be inadvertently separated from the container (which is sometime referred to as a "floating" of the cap), whereas should it be formed offset below the annular projection, the cap would be inserted too much extent into the main body. In both cases, no favorable capping condition can be obtained. Furthermore, the floating of the cap would decrease air-tightness of the container. Since most of recent cosmetic material is volatile, the cosmetic container is required to have an improved air-tightness, otherwise the cosmetic material received therein tends to be deteriorated in a relatively short period of time. Another important requirement for a cosmetic container is easy operation in capping. No prior arts have succeeded to satisfy both requirements.

SUMMARY OF THE INVENTION

Accordingly, it is an object of the present invention to overcome the drawbacks and disadvantages of the prior art cosmetic containers.

Another object of the present invention is to provide a novel construction of a cosmetic container having an improved air-tightness in a capped condition.

Still another object of the present invention is to provide a cosmetic container capable of satisfying two requirements which could not have been completed by the prior art construction, one for providing an improved air-tightness and the other for allowing easy capping operation.

According to an aspect of the present invention there is provided a cosmetic container comprising a housing assembly with an annular external ridge and a cap assembly with an inner cap member engageable with the annular external ridge, characterized in that the inner cap member has a wall portion between upper and lower annular external swells, the wall portion being elastically deformable to provide air-tight engagement with the annular external ridge when the housing assembly is capped with the cap assembly, the lower swell comprising a plurality of spaced segments and acting as a first stopper for preventing removal of the cap assembly from the housing assembly whereas the upper swell comprising an endless continuous ring and acting as a second stopper for preventing excessive insertion of the housing assembly into the cap assembly.

In one embodiment, the lower swell comprises a plurality of spaced segmental annular projections formed substantially around the outer surface of the inner cap member and one or more of dotty projections positioned substantially within each space between adjacent two of the segmental annular projections.

In another embodiment, the lower swell comprises a plurality of spaced segmental annular projections formed substantially around the outer surface of the inner cap member, adjacent two of the segmental annular projections being respectively connected by one or more of connecting ribs having the width smaller than the segmental annular projections. There may be provided auxiliary ribs above and below each of the connecting ribs.

In still another embodiment, the lower swell comprises a plurality of spaced segmental annular projections formed substantially around the outer surface of the inner cap member, adjacent two of the segmental annular projections being respectively connected by connecting parts having the same width with the segmental annular projections. In this embodiment, the lower portion of each of the connecting part may be cut out to provide a slanting bottom surface, or provide an arcuate bottom in cross-section, or provide a substantially S-shaped bottom in cross-section. There may be provided auxiliary ribs above and below each of the connecting parts.

The wall portion between the upper and lower annular external swells may be entirely or partly recessed to provide the elastically deformable wall portion.

One or more of longitudinal projections may be formed on the outer surface of the inner cap member, which extend downward from the lower annular external swell to substantially a lower end of the inner cap member.

According to another aspect of the present invention there is provided a cosmetic container comprising a housing assembly with an annular external ridge and a cap assembly with an inner cap member engageable with the annular external ridge, characterized in that the inner cap member has a wall portion between upper and lower annular external swells, the wall portion being elastically deformable to provide air-tight engagement with the annular external ridge when the housing assembly is capped with the cap assembly, the lower swell being formed to have a wavy periphery in radial cross-section and acting as a first stopper for preventing removal of the cap assembly from the housing assembly whereas the upper swell comprising an endless continuous ring and acting as a second stopper for preventing excessive insertion of the housing assembly into the cap assembly.

In one embodiment, the lower swell has a wavy periphery comprising a continuous curved edge having regularly repeated tops and bottoms.

In another embodiment, the wavy periphery of the lower swell is formed as a milled edge having regularly repeated tops and bottoms.

In still another embodiment, the wavy periphery of the lower swell is formed as a series of arcs of the same diameter.

One or more of longitudinal projections may be formed on the outer surface of the inner cap member, which extend downward from the lower annular external swell to substantially a lower end of the inner cap member. The longitudinal projections may extend from top portions or bottom portions of the wavy periphery of the lower swell.

According to still another aspect of the present invention there is provided a cosmetic container comprising a housing assembly with an annular external ridge and a cap assembly with an inner cap member engageable with the annular external ridge, characterized in that the inner cap member has a wall portion between upper and lower annular external swells, the wall portion being elastically deformable to provide air-tight engagement with the annular external ridge when the housing assembly is capped with the cap assembly, and that the inner cap member has one or more of longitudinal projections on the outer surface thereof which extend downward from the lower annular external swell to substantially a lower end of the inner cap member, the lower swell having a circular cross-section and acting as a first stopper for preventing removal of the cap assembly from the housing assembly whereas the upper swell comprising an endless continuous ring and acting as a second stopper for preventing excessive insertion of the housing assembly into the cap assembly.

The lower swell may comprise an endless continuous ring of a circular cross-section or a plurality of spaced annular projections. The lower swell may also comprise a plurality of spaced segmental annular projections formed substantially around the outer surface of the inner cap member and one or more of dotty projections positioned substantially within each space between adjacent two of the segmental annular projections. The lower swell may also comprise a plurality of spaced segmental annular projections formed substantially around the outer surface of the inner cap member, adjacent two of the segmental annular projections being respectively connected by one or more of connecting ribs having the width smaller than the segmental annular projections.

The lower swell may also comprise a plurality of spaced segmental annular projections formed substantially around the outer surface of the inner cap member, adjacent two of the segmental annular projections being respectively connected by connecting parts having the same width with the segmental annular projections. In this embodiment, the lower portion of each of the connecting part may be cut out to provide a slanting bottom surface, or provide an arcuate bottom in cross-section, or provide a substantially S-shaped bottom in cross-section. There may be provided auxiliary ribs above and below each of the connecting ribs or parts. The wall portion between the upper and lower annular external swells may be entirely or partly recessed to provide the elastically deformable thinned wall portion.

BRIEF DESCRIPTION OF THE DRAWINGS

Other objects and advantages of the present invention can be understood from the following description when read in conjunction with the accompanying drawings in which:

FIG. 1 shows a lipstick container according to a first embodiment of the present invention in an incompletely capped condition, in which

FIG. 2 shows the lipstick container of FIG. 1 in a completely capped condition, in which

FIG. 3 shows an example of a first embodiment of an inner cap to be used in the lipstick container of FIGS. 1 and 2, in which

FIG. 4 shows a modification of the inner cap of FIG. 3, in which

FIG. 5 shows another modification of the inner cap of FIG. 3, in which

FIG. 6 shows another example of the first embodiment of the inner cap, in which

FIG. 7 shows a modification of the inner cap of FIG. 6, in which

FIG. 8 shows still another example of the first embodiment of the inner cap, in which

FIG. 9 shows a modification of the inner cap of FIG. 8, in which

FIG. 10 shows another modification of the inner cap of FIG. 8, in which

FIG. 11 shows a second embodiment of the inner cap, in which

FIG. 12 shows a modification of the inner cap of FIG. 11, in which

FIG. 13 shows still another modification of the inner cap of FIG. 11, in which

FIG. 14 shows still another modification of the inner cap of FIG. 11, in which

FIG. 15 shows still another modification of the inner cap of FIG. 11, in which

FIG. 16 shows a third embodiment of the inner cap, in which

FIG. 17 shows a modification of the inner cap of FIG. 16, in which FIG. 18 shows another modification of the inner cap of FIG. 16, in which

DETAILED DESCRIPTION OF THE PREFERRED EMBODIMENTS

Some preferred embodiments according to the present invention will be described hereinbelow in reference to the accompanying drawings. The same functional parts and elements are shown by the same reference numbers throughout the drawings.

Figure 1A:
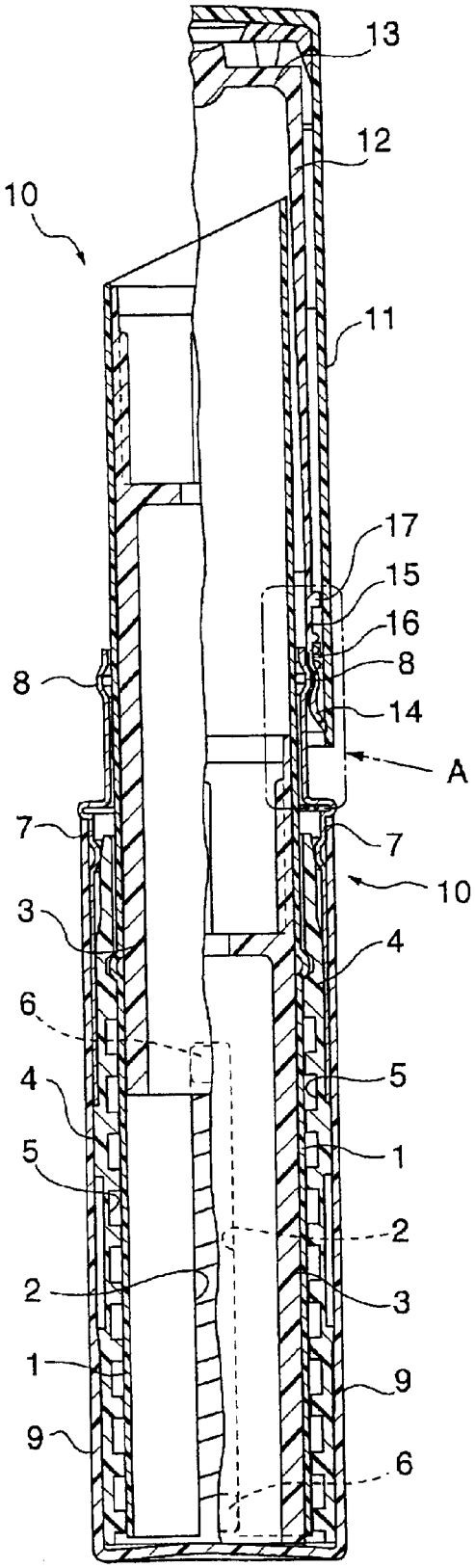
FIG. 1(A) is a vertical cross-section thereof and FIG. 1(B) is an enlarged view showing "A" part in FIG. 1(A)
Figure 1B:
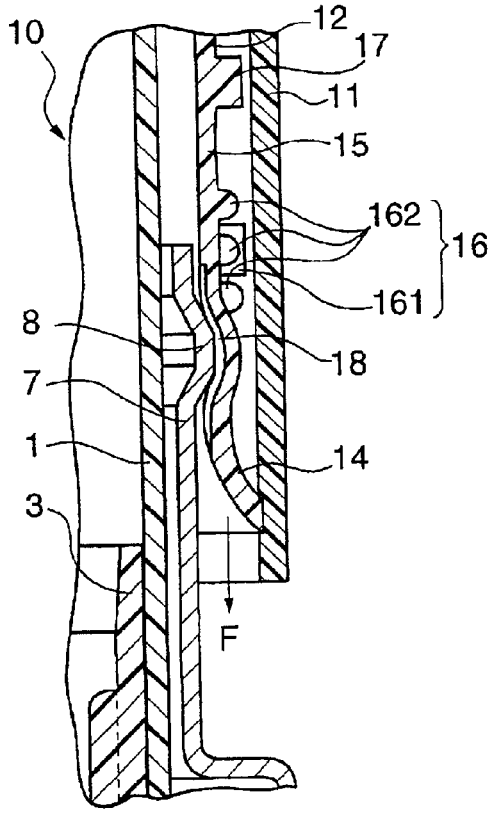
Figure 2A:
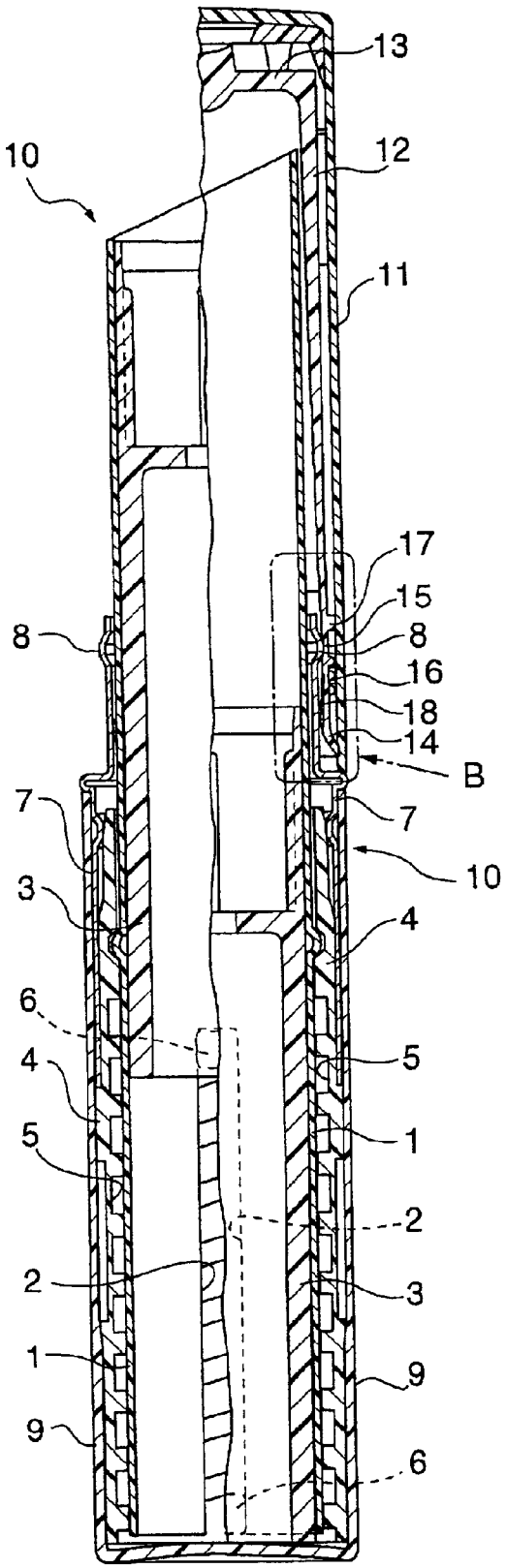
FIG. 2(A) is a vertical cross-section thereof and FIG. 2(B) is an enlarged view showing "B" part in FIG. 2(A)

FIGS. 1 and 2 illustrate a cosmetic container embodying the present invention, in which it is in an incompletely capped condition in FIG. 1 whereas in a completely capped condition in FIG. 2. In FIGS. 1(A) and 2(A), a first half of the cosmetic container is shown in a vertical cross-section taken along a first vertical plane and a second half is shown in another vertical cross-section taken along a second vertical plane perpendicular to the first vertical plane. The cosmetic container 10 comprises, in general, a stationary tubular main body 1, a cosmetic holder 3 that is received in main body 1 and, in turn, accommodates a stick-like cosmetic such as a lipstick (not shown), a rotatable outer body 4 that holds main body 1, a casing 9 integrally press-fit around outer body 4, an insert sleeve 7 integrally fitted onto the upper end portion of outer body 4, and a cap 11 mechanically fittable onto insert sleeve 7. Main body 1 has a pair of opposed axially elongated slots 2, through which a pair of opposed projections 6, 6 extends outwardly from cosmetic holder 3 to be engaged within a continuous spiral groove 5 on the inner surface of outer body 4. Thus, cosmetic holder 3 is vertically slideable in the stationary main body 1 in response to rotation of casing 9 and outer body 4. Insert sleeve 7 has an annular external ridge 8.

Cap 11 includes an inner cap member 12 of resin material having a circular cross-sectional inner wall. Inner cap member 12 is secured to cap 11 at its top 13 and an enlarged elastic bottom 14. The side wall portion of inner cap member 12 has an elastic portion 15 formed between a pair of spaced swells or outward projections 16, 17. In this embodiment, each swell 16, 17 is defined by a flat inner surface that is co-planer with the inside surface of inner cap member 12 and an external projection of substantially a rectangular cross-section. The upper swell 17 is a continuous ring. Below the lower swell 16, inner cap member 12 has a knurling inside surface 18.

Lower swell 16 will be described in detail in reference to FIGS. 3–18. FIG. 3 shows lower swell 16 according to a first embodiment of the present invention, comprising three, equally spaced, annular ridges 161 formed around the outer surface of inner cap member 12 and three semi-spherical projections 162 positioned in each space between two adjacent annular ridges 161. Annular ridges 161 are taller than semi-spherical projections 162. Three semi-spherical projections 162 are arranged in an oblique line with respect to annular ridges 161. Elastic portion 15 between upper and lower swells 17, 16 has a thickness substantially equal to another wall portion above upper swell 17, but the outer surface of its middle area is recessed to have a reduced thickness.

Figure 4A:
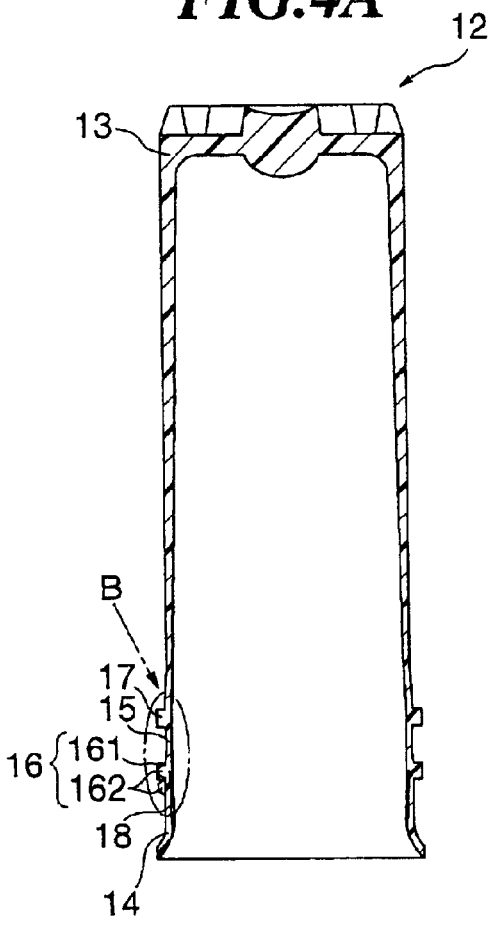
FIG. 4(A) is a vertical cross-section thereof and FIG. 4(B) is an enlarged view of "B" part in FIG. 4(A)
Figure 4B:
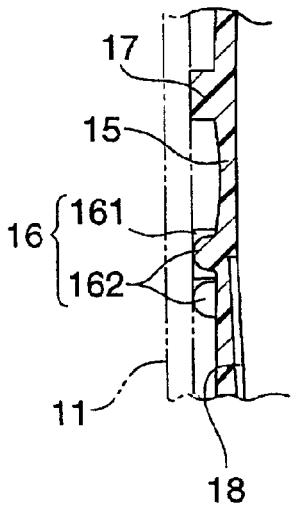
Figure 5A:
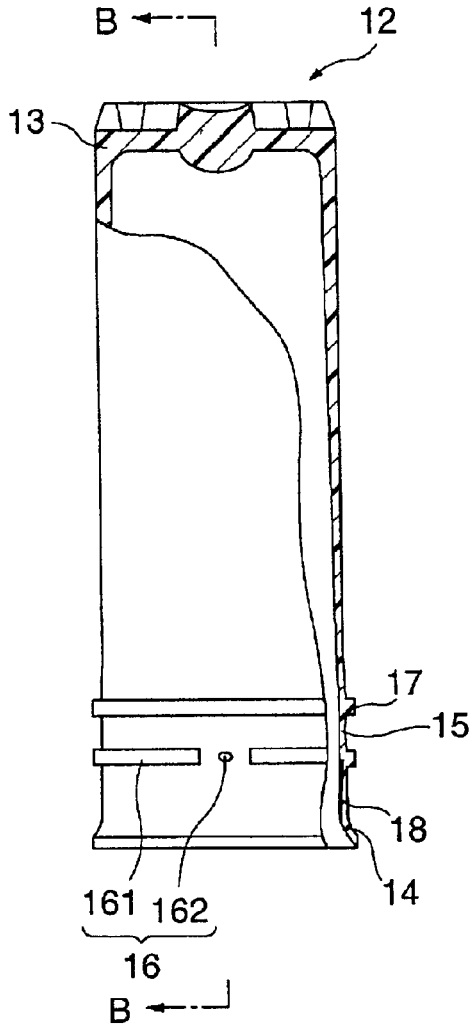
FIG. 5(A) is a front view thereof which is partly cut away to be shown in a vertical cross-section.
Figure 5B:
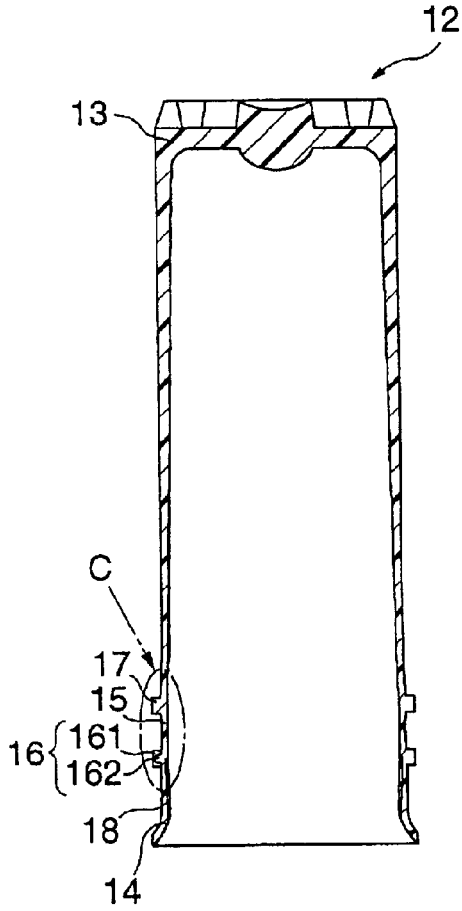
FIG. 5(B) is a vertical cross-section taken along B—B line in FIG. 5(A) and FIG. 5(C) is an enlarged view showing "C" part in FIG. 5(B)
Figure 5C:
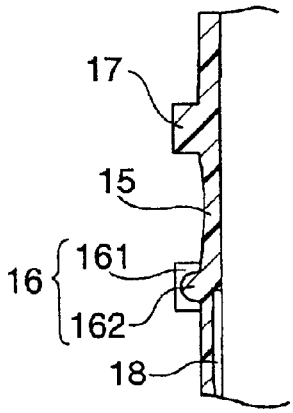
Figure 6A:
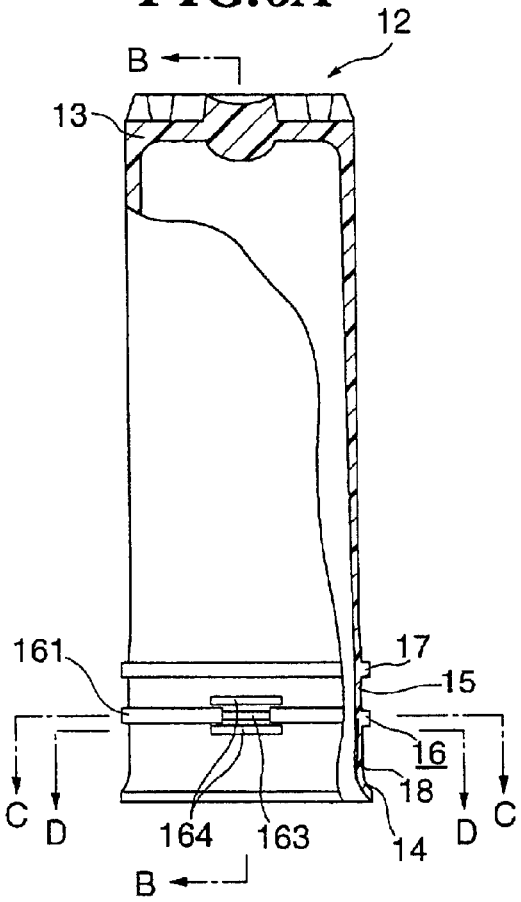
FIG. 6(A) is a front view thereof which is partly cut away to be shown in a vertical cross-section.
Figure 6B:
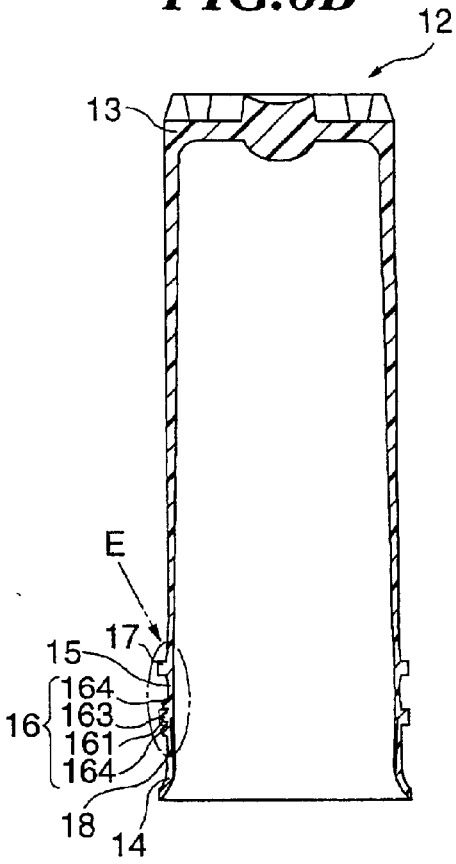
FIG. 6(B) is a vertical cross-section taken along B—B line in FIG. 6(A)
Figure 6C:
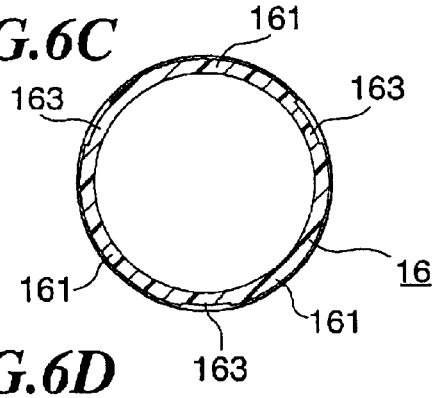
FIG. 6(C) is a horizontal cross-section taken along C—C line in FIG. 6(A)
Figure 6D:
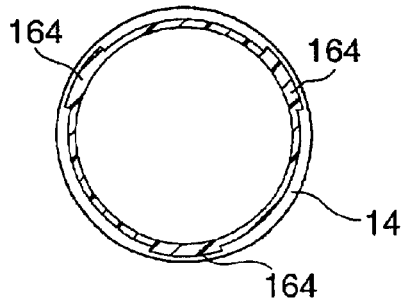
FIG. 6(D) is a horizontal cross-section taken along D—D line in FIG. 6(A)
Figure 6E:
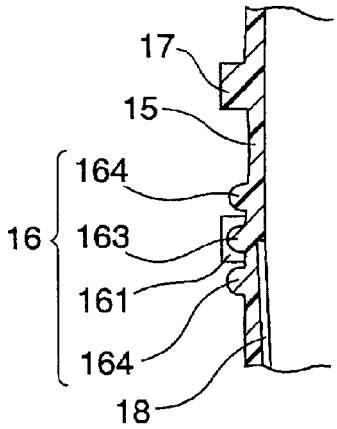
FIG. 6(E) is an enlarged view showing "E" part in FIG. 6(B)

Lower swell 16 shown in FIG. 3 may be modified as shown in FIG. 4 or FIG. 5. In FIG. 4, there is a modification that three semi-spherical projections 162 have height substantially equal to annular ridges 161. In FIG. 5, lower swell 16 is modified such that there is only one semi-spherical projection 162 at each space between two adjacent annular ridges 161. Apart from the features regarding lower swell 16, these embodiments shown in FIGS. 4 and 5 are substantially identical to the embodiment shown in FIG. 3.

Figure 2B:
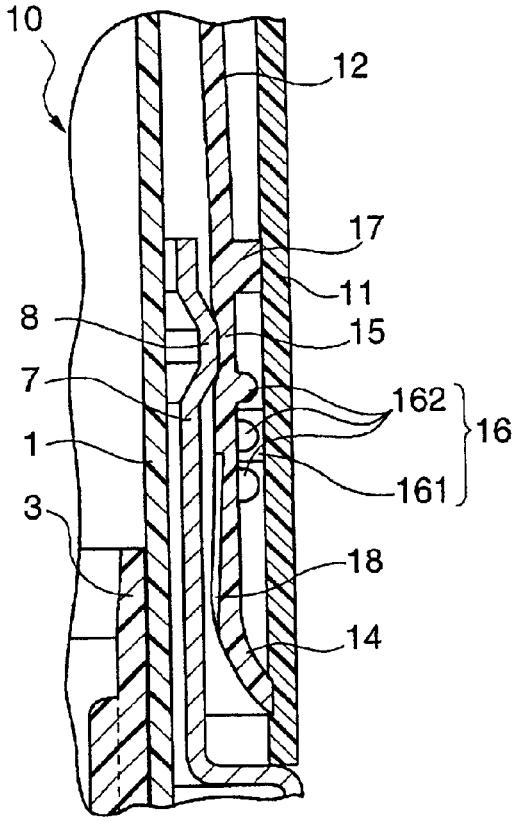
Figure 3A:
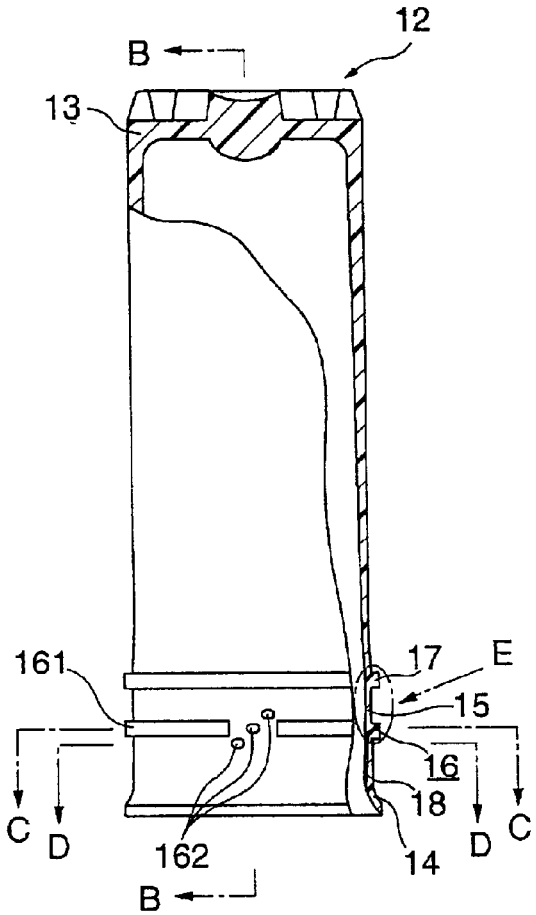
FIG. 3(A) is a front view thereof which is partly cut away to be shown in a vertical cross-section.
Figure 3B:
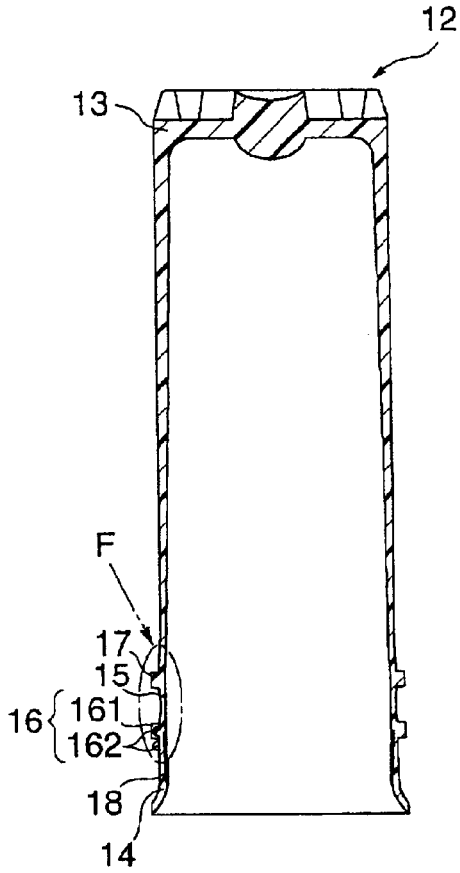
FIG. 3(B) is a vertical cross-section taken along B—B line in FIG. 3(A)
Figure 3C:
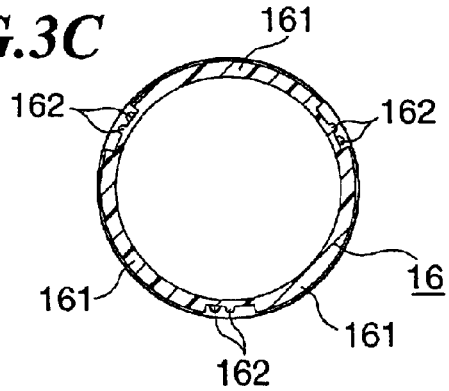
FIG. 3(C) is a horizontal cross-section taken along C—C line in FIG. 3(A)
Figure 3E:
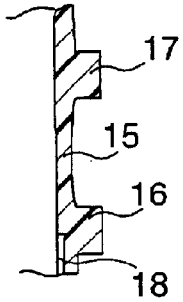
FIG. 3(E) is an enlarged view showing "E" part in FIG. 3(A) and FIG. 3(F) is an enlarged view showing "F" part in FIG. 3(B)
Figure 3F:
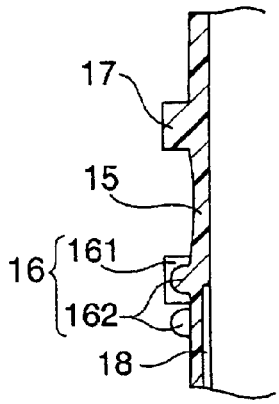
Figure 3D:
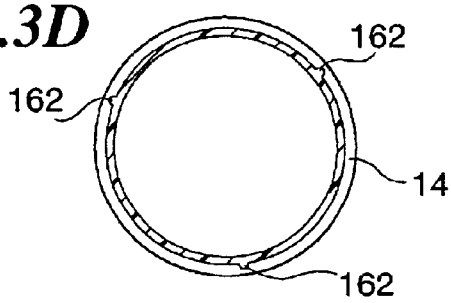
FIG. 3(D) is a horizontal cross-section taken along D—D line in FIG. 3(A)

With the above-described embodiments, when cap 11 is placed onto insert sleeve 7, annular external ridge 8 is first positioned in contact with knurling inside surface 18 of inner cap member 12, as best seen in FIG. 1(B). Then, by applying a downward force F to cap 11, lower swell 16 climbs over ridge 8, as shown in FIG. 2(B) so that inner cap member 12 comes to a standstill in a completely capped condition. In this condition, ridge 8 rests at elastic portion 15 which is easily deformed to be tightly adhered to ridge 8, thereby providing an improved air-tight property to container 10. Accordingly, when container 10 is used to receive a volatile cosmetic material, it prevents the volatile cosmetic material from deterioration over a longer period of time. Upper swell 17 is less deformable and therefore acts as a stopper for preventing excessive insertion of insert sleeve 7. Lower swell 16 acts as another stopper for preventing inadvertent removal of cap 11. Since elastic portion 15 is simply formed as a substantially straightforward tubular section, even if there is some displacement in engagement between cap 11 and inner cap member 12, ridge 8 is surely positioned in press-contact with this portion 15 in the capped condition as shown in FIG. 2(B).

More specifically, a portion of inner cap member 12 including lower swell 16 should be enlarged when lower swell 16 climbs over ridge 8 of insert sleeve 7 during insertion of cap 11 onto the top of insert sleeve 7. Lower swell 16 comprises a series of spaced annular ridges 161, which facilitate enlargement of inner cap member during capping operation. This also decreases a capping operation force F and contributes to smooth insertion of cap 11. After lower swell 16 has climbed over ridge 8, it will be readily restored to its original diameter due to semi-spherical projections 162 positioned in each space between two adjacent annular projections 161, thereby improving air-tightness of container 10. Elastic portion 15 having upper and lower thick areas and a thinner middle area is well deformable and restorable to air-tightly receive ridge 8.

The elastic portion 15 formed between upper and lower swells 17, 16 has a smooth inner surface extending over a sufficient axial length, during which ridge 8 of insert sleeve 7 may surely be positioned in a capped condition, even if these is some displacement in coupling between insert sleeve 7 and inner cap member 12. This prevents "floating" of cap 11 with respect to main body 1 and increases air-tightness of container 10.

In the above-described embodiments, lower swell 16 is formed not as a continuous annular projection but as a series of spaced annular ridges 161, which allows ridge 8 to have a wide variety of its diameter. Should the lower swell 16 comprise a continuous annular projection, it is necessary that ridge 8 has a definite diameter which is determined in relation to an inner diameter of inner cap member 12. Ridge 8 having a larger diameter is difficult to climb over lower swell 16 which prevents smooth capping and uncapping operation, whereas ridge 8 having a smaller diameter can not attain air-tight engagement between inner sleeve 7 and inner cap member 12.

In the first embodiment in which lower swell 16 includes semi-spherical projections 162, there is a relatively wide space between adjacent annular projections 161, 161, which facilitates inner cap member 12 to be elastically enlarged for smooth capping operation. In the embodiment of FIG. 4, semi-spherical projections 162 comes into contact with the inner surface of cap 11 in a capped condition, which further improves air-tightness.

FIG. 6 shows another example of lower swell 16 according to the first embodiment of the present invention, comprising three, equally spaced, annular ridges 161 formed around the outer surface of inner cap member 12 and connecting ribs 163 each connecting two adjacent annular ridges 161 one another. Each connecting rib 163 is narrower and shorter than annular projection 161 and has a semi-spherical cross-section. Spaced above and below each connecting rib 163, there are auxiliary semi-spherical ribs 164, 164 in parallel relation therewith. Apart from these features, the embodiment of FIG. 6 is similar to the embodiment of FIG. 3.

Figure 7A:
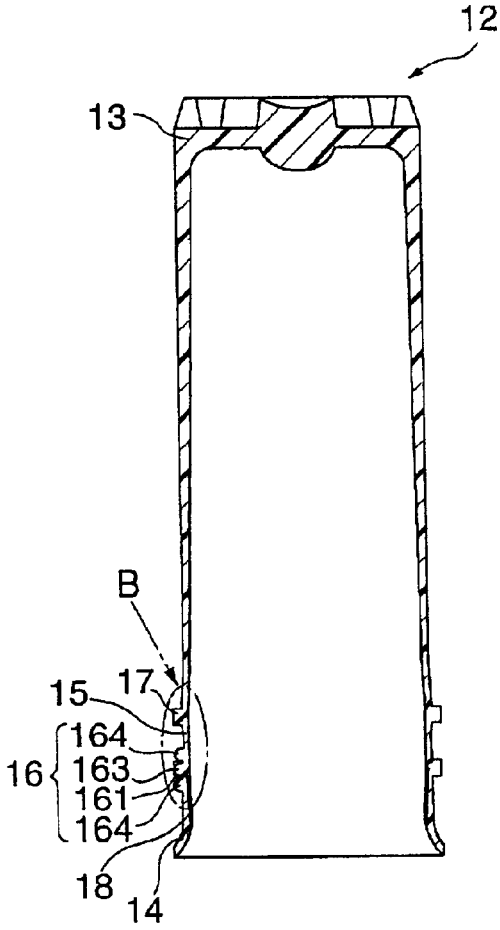
FIG. 7(A) is a vertical cross-section thereof and FIG. 7(B) is an enlarged view of "B" part in FIG. 7(A)
Figure 7B:
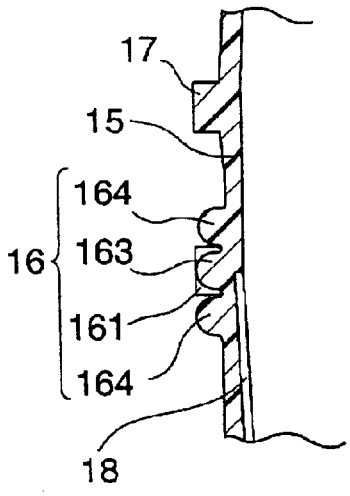
Figure 8A:
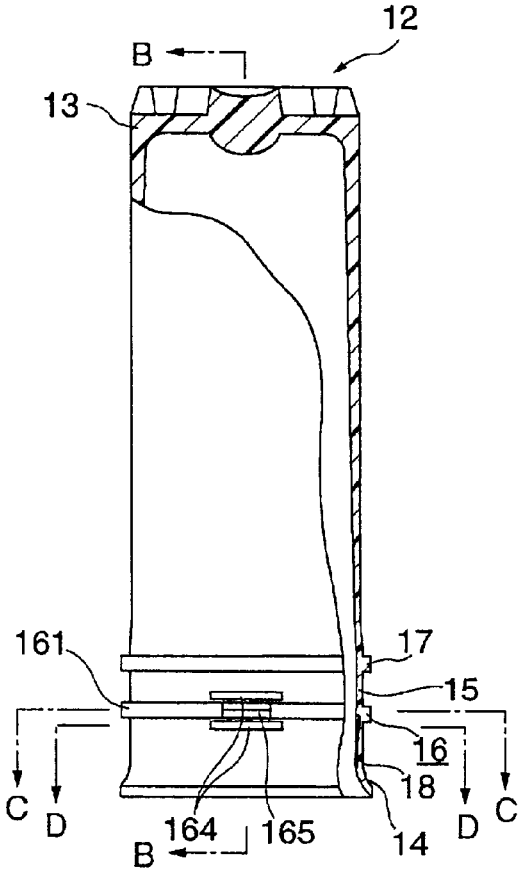
FIG. 8(A) is a front view thereof which is partly cut away to be shown in a vertical cross-section.
Figure 8B:
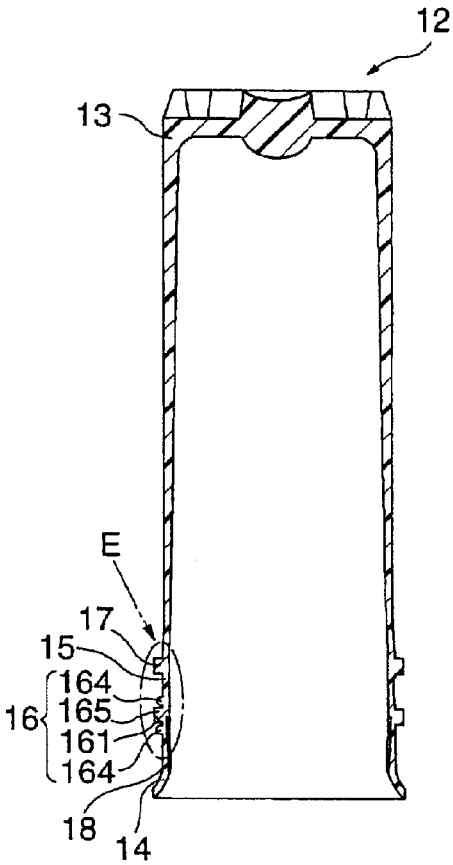
FIG. 8(B) is a vertical cross-section taken along B—B line in FIG. 8(A)
Figure 8C:
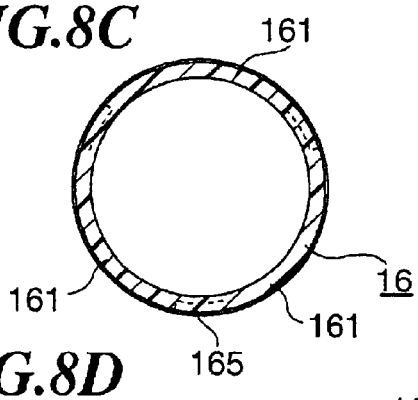
FIG. 8(C) is a horizontal cross-section taken along C—C line in FIG. 8(A)
Figure 8D:
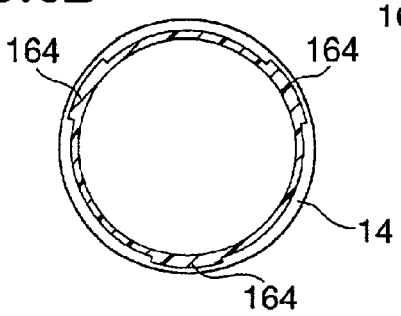
FIG. 8(D) is a horizontal cross-section taken along D—D line in FIG. 8(A)
Figure 8E:
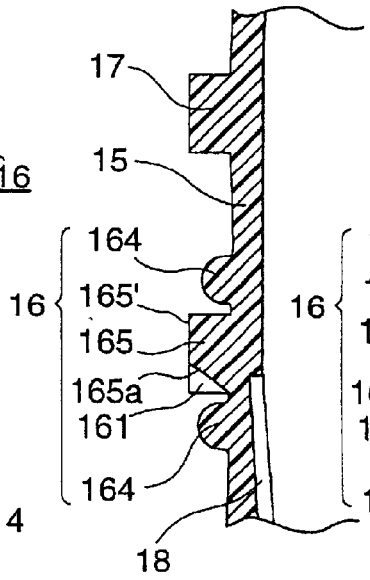
FIG. 8(E) is an enlarged view showing "E" part in FIG. 8(A) and FIG. 8(F) is an enlarged view showing "F" part in FIG. 8(B) when fitted onto the insert sleeve.
Figure 8F:
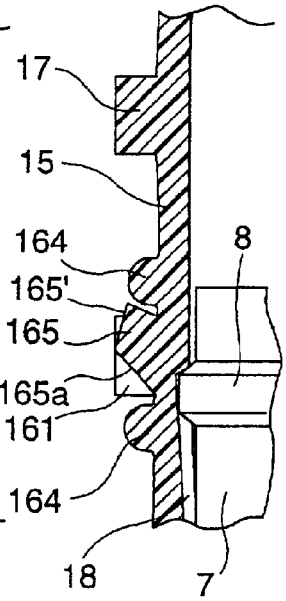

In a modification of FIG. 7, both of connecting ribs 163 and auxiliary ribs 164 is substantially equal in height to annular ridges 161. Apart from this feature, this embodiment is similar to the embodiment of FIG. 6.

The embodiments shown in FIGS. 6 and 7 provide similar advantages and functions as having been described in connection with FIGS. 3–5. Inner cap member 12 is easily deformable and expandable because lower swell 16 comprises a series of spaced annular ridges 161. Upper and lower auxiliary ribs 164, 164 cooperate with connecting rib 163 to further improve air-tightness of container 10. Specifically, upper rib 164 adsorbs vertical offset of annular projection or ridge 8 of insert sleeve 7 with respect to inner cap member 12 in a capped condition.

FIG. 8 shows another example of the first embodiment of the present invention, wherein lower swell 16 comprises three, equally spaced, annular ridges 161 formed around the outer surface of inner cap member 12 and connecting parts 165 each connecting two adjacent annular ridges 161 one another. Each connecting part 165 has width and height both substantially equal to annular projection 161 and has a lower cut-out portion 165*a* providing a slanting bottom surface. Spaced above and below each connecting part 165, there are auxiliary ribs 164, 164 of semi-spherical cross-section in parallel relation therewith. Apart from these features, the embodiment of FIG. 6 is similar to the embodiment of FIG. 3.

Figure 9A:
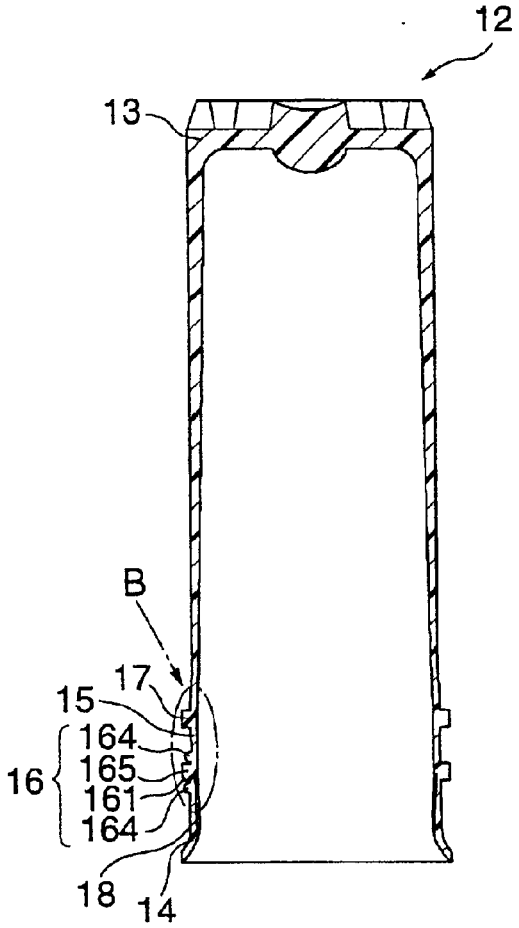
FIG. 9(A) is a front view thereof which is partly cut away to be shown in a vertical cross-section.
Figure 9B:
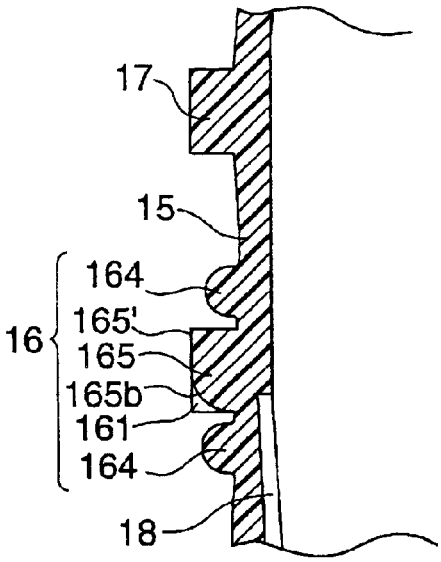
FIG. 9(B) is an enlarged view showing "B" part in FIG. 9(A) and FIG. 9(C) is an enlarged view showing "B" part in a fitted condition.
Figure 9C:
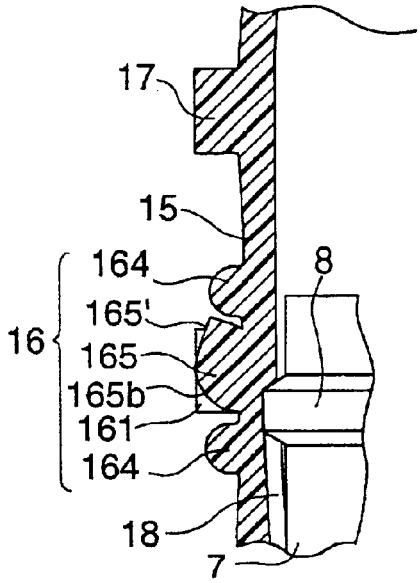
Figure 10A:
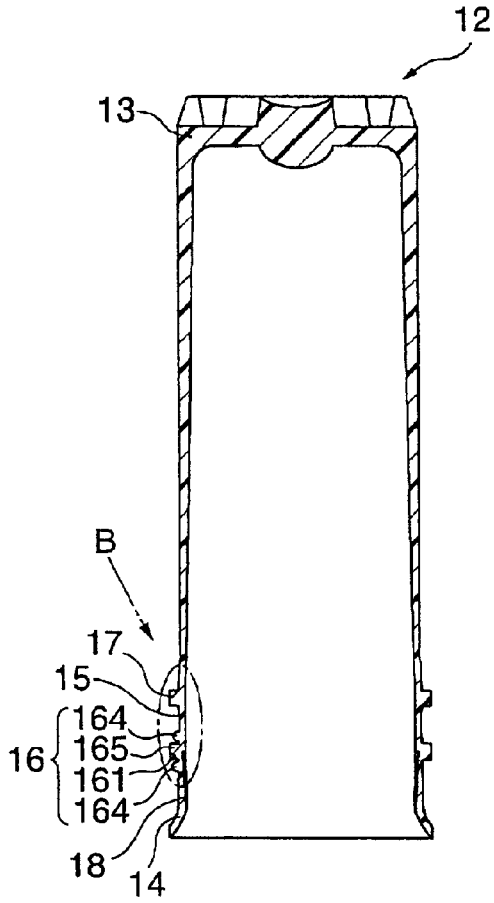
FIG. 10(A) is a front view thereof which is partly cut away to be shown in a vertical cross-section.
Figure 10B:
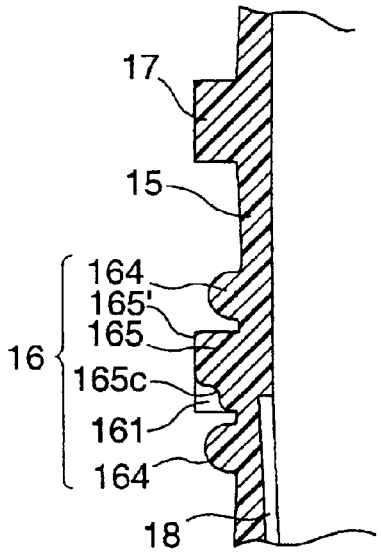
FIG. 10(B) is an enlarged view showing "B" part in FIG. 10(A) and FIG. 10(C) is an enlarged view showing "B" part in a fitted condition.

FIGS. 9 and 10 show modifications having different shapes of connecting parts 165 in the example of FIG. 8. In FIG. 9, each connecting part 165 has a lower cut-out portion 165*b* providing an arcuate bottom in cross-section. In FIG. 10, each connecting part 165 has a lower cut-out portion 165*c* providing a substantially S-shaped bottom in cross-section. Apart from the shape of connecting parts 165, these embodiments of FIGS. 9 and 10 are similar to the embodiment of FIG. 8.

Figure 10C:
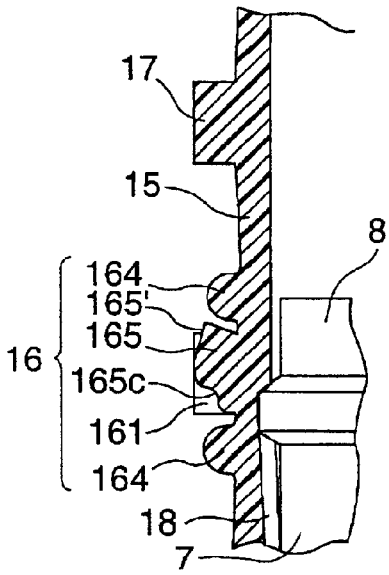
Figure 11A:
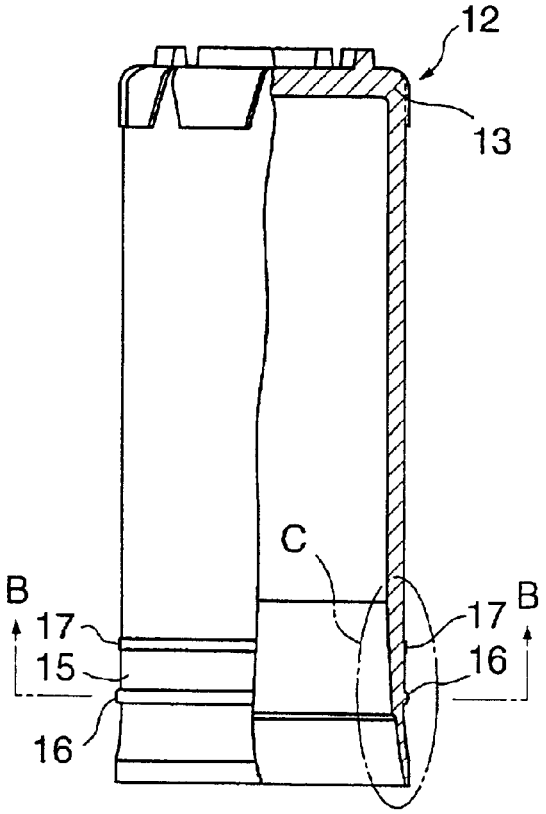
FIG. 11(A) is a front view thereof which is partly cut away to be shown in a vertical cross-section.
Figure 11B:
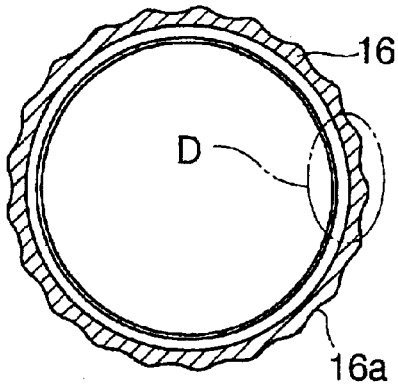
FIG. 11(B) is a horizontal cross-section taken along B—B line in FIG. 11(A)
Figure 11C:
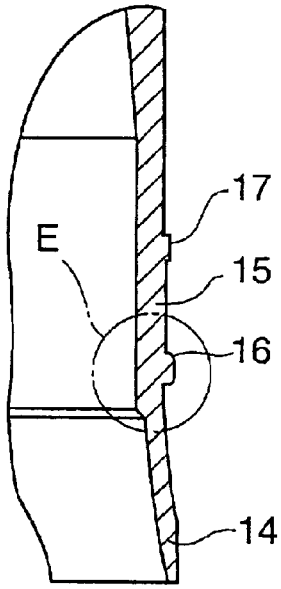
FIG. 11(C) is an enlarged view showing "C" part in FIG. 11(A)
Figure 11D:
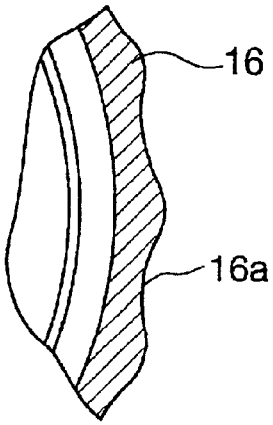
FIG. 11(D) is an enlarged view showing "D" part in FIG. 11(B) and FIG. 11(E) is an enlarged view showing "E" part in FIG. 11(C)
Figure 11E:
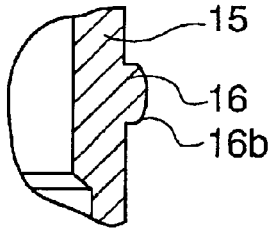

Consequently, these embodiments shown in FIGS. 8–10 provide similar advantages and functions as having been described in connection with FIGS. 3–5. In addition, since each connecting part 165 of lower swell 16 has lower cut-out portions 165*a*, 165*b*, 165*c*, when ridge 8 of insert sleeve 7 becomes in press-contact with the outer surface of lower swell 16 during capping, an upper portion 165' tends to be inclined inwardly (that is, toward insert sleeve 7) as shown in FIGS. 8(F), 9(C) and 10(C). This will further reduce the capping operation force F to be required when lower swell 16 climbs over ridge 8 of insert sleeve 7 during capping and, therefore, facilitate smooth engagement therebetween. Connecting parts 165 having the same height with annular projections 161 are well adhered to the inner surface of cap 11 in a capped condition, which improves air-tightness of container 10.

FIGS. 11–15 illustrates some examples according to a second embodiment of the present invention wherein lower swell 16 is formed to have a wavy periphery in horizontal cross-section. In an example of FIG. 11, as best seen in FIG. 11 (D), lower swell 16 has a wavy periphery 16*a* comprising a continuous curved edge having regularly repeated tops and bottoms. In this example, lower swell 16 is an endless annular projection. Lower swell 16 has an arcuate cross-section 16*b* in its axial direction, as best seen in FIG. 11(E).

Figure 12A:
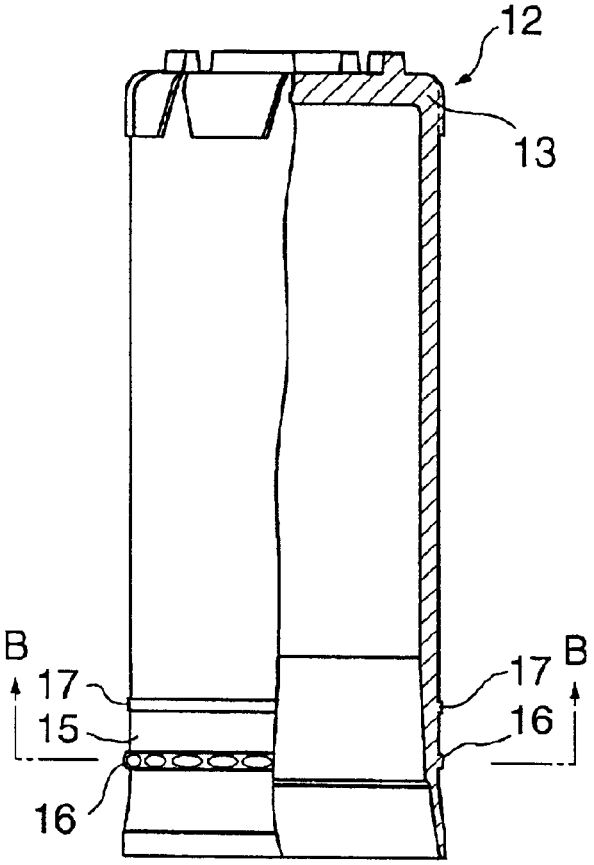
FIG. 12(A) is a front view thereof which is partly cut away to be shown in a vertical cross-section.
Figure 12B:
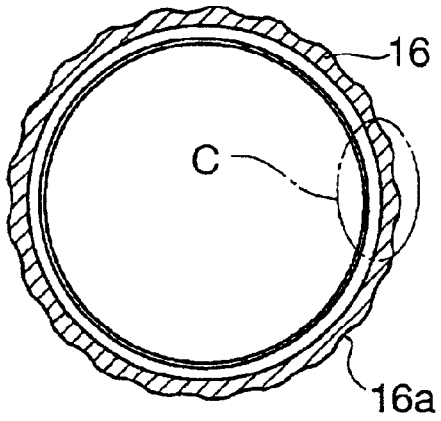
FIG. 12(B) is a horizontal cross-section taken along B—B line in FIG. 12(A) and FIG. 12(C) is an enlarged view showing "C" part in FIG. 12(B)
Figure 12C:
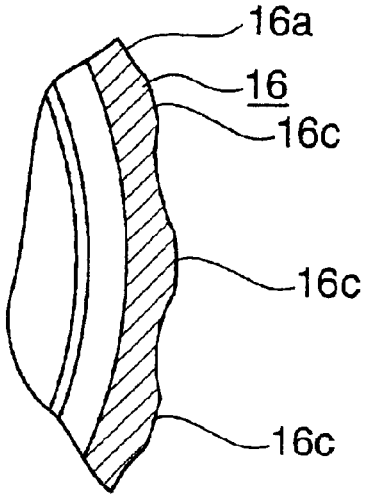

In a modified example shown in FIG. 12, the wavy periphery 16*a* of lower swell 16 includes flat sections 16*c* at the top. In a further modification, the wavy periphery 16*a* includes flat sections at the bottom, though not specifically shown.

Figure 13A:
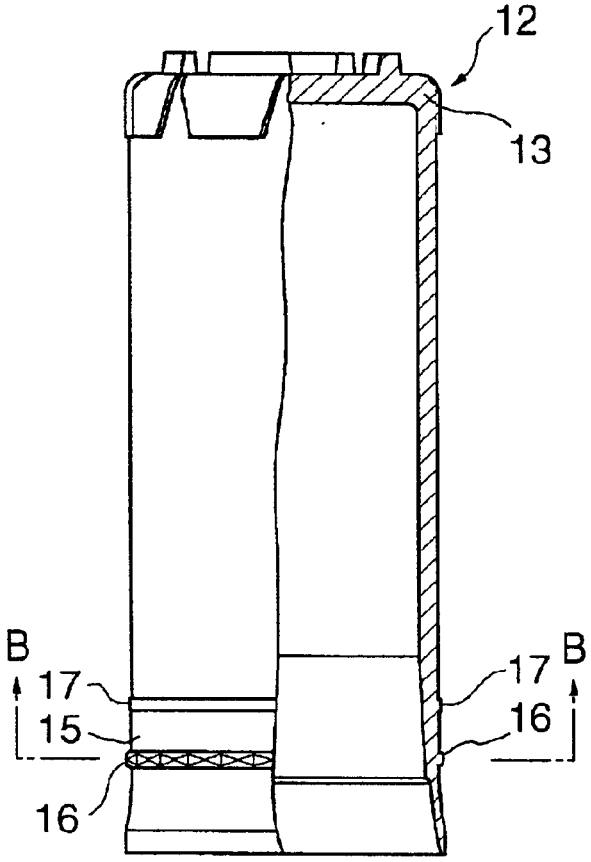
FIG. 13(A) is a front view thereof which is partly cut away to be shown in a vertical cross-section.
Figure 13B:
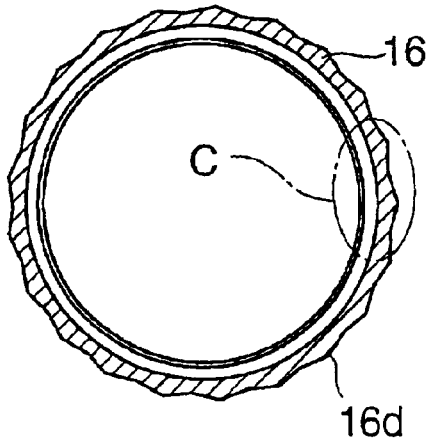
FIG. 13(B) is a horizontal cross-section taken along B—B line in FIG. 13(A) and FIG. 13(C) is an enlarged view showing "C" part in FIG. 13(B)
Figure 13C:
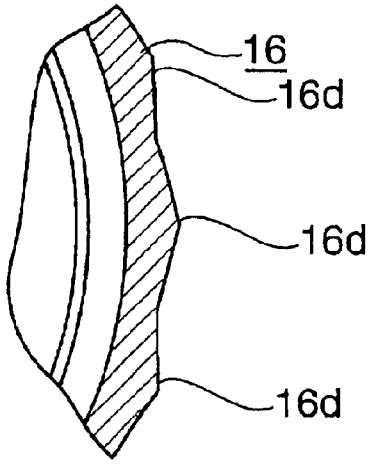

In a still modified example shown in FIG. 13, the wavy periphery of lower swell 16 is formed as a milled edge 16*d* having regularly repeated tops and bottoms.

Figure 14A:
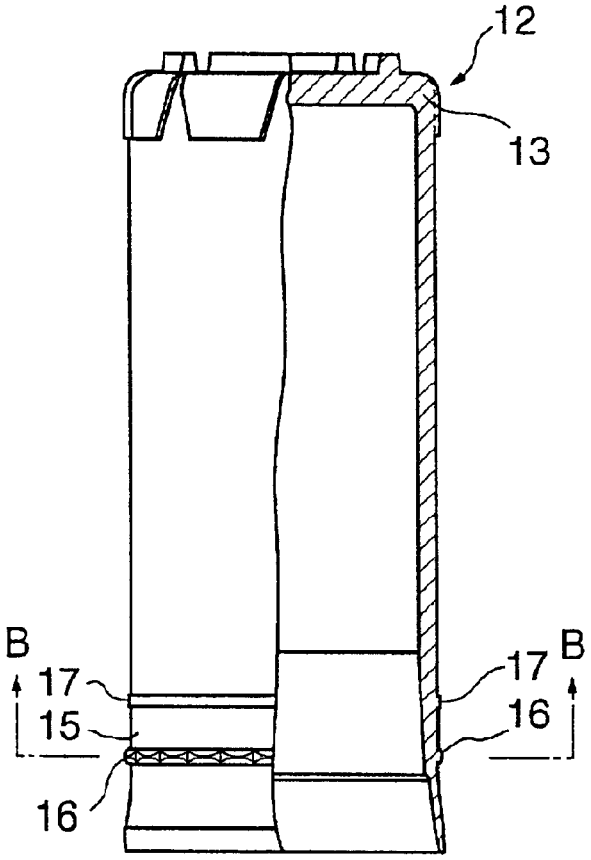
FIG. 14(A) is a front view thereof which is partly cut away to be shown in a vertical cross-section.
Figure 14B:
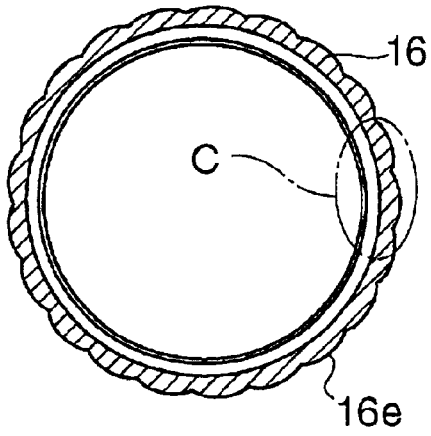
FIG. 14(B) is a horizontal cross-section taken along B—B line in FIG. 14(A) and FIG. 14(C) is an enlarged view showing "C" part in FIG. 14(B)
Figure 14C:
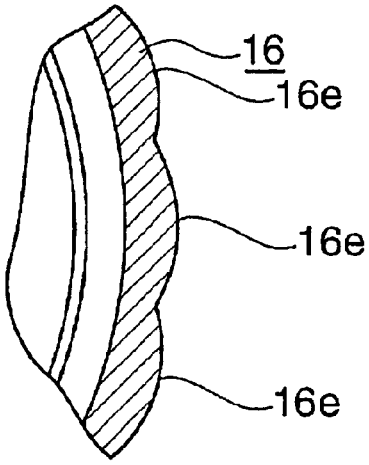
Figure 15A:
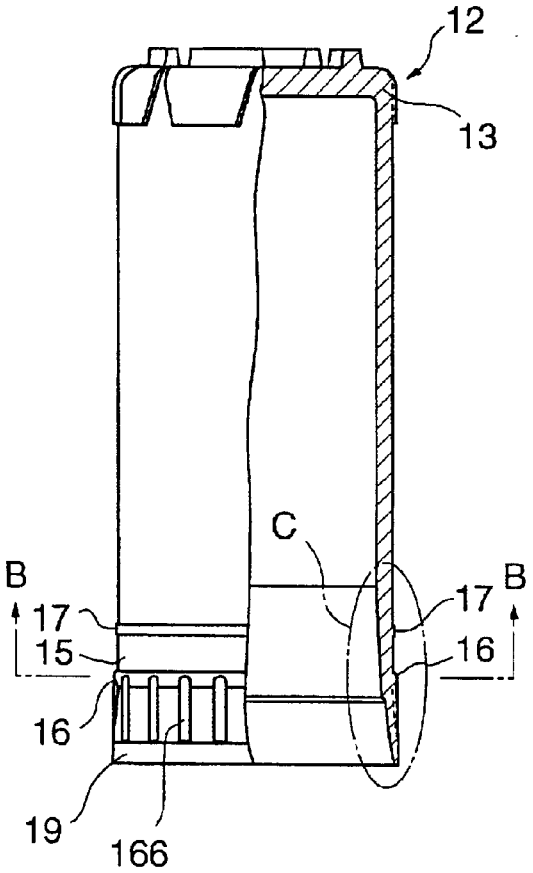
FIG. 15(A) is a front view thereof which is partly cut away to be shown in a vertical cross-section.
Figure 15B:
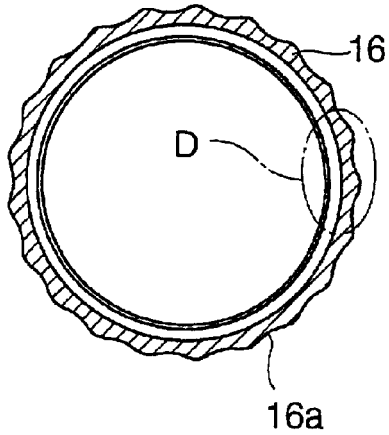
FIG. 15(B) is a horizontal cross-section taken along B—B line in FIG. 15(A)
Figure 15C:
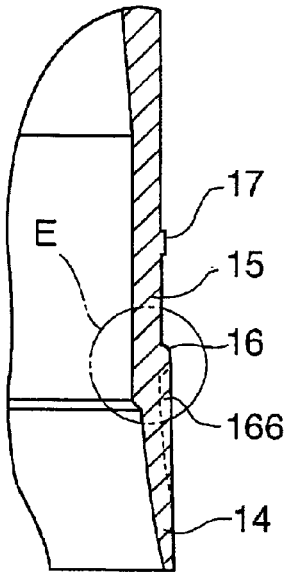
FIG. 15(C) is an enlarged view showing "C" part in FIG. 15(A)
Figure 15D:
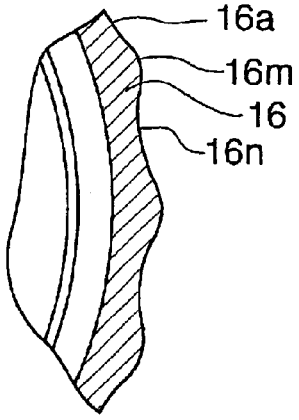
FIG. 15(D) is an enlarged view showing "D" part in FIG. 15(B) and FIG. 15(E) is an enlarged view showing "E" part in FIG. 15(C)
Figure 15E:
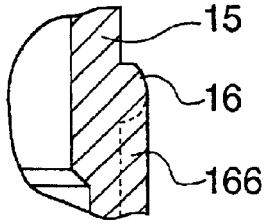

In a still modified example shown in FIG. 14, the wavy periphery of lower swell 16 is formed as a series of arcs 16*e* of the same diameter.

In these examples, there may be a plurality of protrusions 166 extending between lower swell 16 and a lower end 19 of inner cap member 12, as shown in FIG. 15. Although the upper end of each protrusions 166 is merged into a top 16*m* of the wavy periphery 16*a* of lower swell 16, it may also be merged into a bottom 16*n*.

Apart from the above-described features, these examples of FIGS. 11–15 according to the second embodiment are similar to the first embodiment.

In accordance with the second embodiment of the present invention, while lower swell 16 is formed as a continuous annular projection, its wavy periphery in radial cross-section facilitates elastic deformation or enlargement of lower swell 16 when insertion of inner cap member 12, thereby decreasing the capping operation force F and smoothening engagement of cap 11. After cap 11 is fitted, inner cap member 12 will readily be returned to its original configuration because lower swell 16 is a continuous annular projection, which provides an improved air-tightness of container 10. When longitudinal protrusions 166 extend downward from lower swell 16 as in the example of FIG. 15, engagement of cap 11 with main body 1 may be maintained even if lower swell 16 do not have a sufficient axial length, which prevents inadvertent separation of cap 11 from main body 1 and further improves air-tightness of container 10.

In the second embodiment of the present invention, when elastic portion 15 has a thinned wall area at the middle, the capping operation may further be smoothened, as having been described in connection with the first embodiment. In this design, elastic portion 15 may readily be returned to its original configuration to become close contact with ridge 8 of insert sleeve 7, which further improves air-tightness of container 10. The elastic portion 15 formed between upper and lower swells 17, 16 has a smooth inner surface extending over a sufficient axial length, during which ridge 8 of insert sleeve 7 may surely be positioned in a capped condition, even if these is some displacement in coupling between insert sleeve 7 and inner cap member 12. This prevents "floating" of cap 11 with respect to main body 1 and increases air-tightness of container 10.

Although lower swell 16 in each example of the second embodiment is shown as a continuous annular projection, it may be a series of several spaced annular projections, as shown in the examples of the first embodiment of FIGS. 1–10.

Figure 16A:
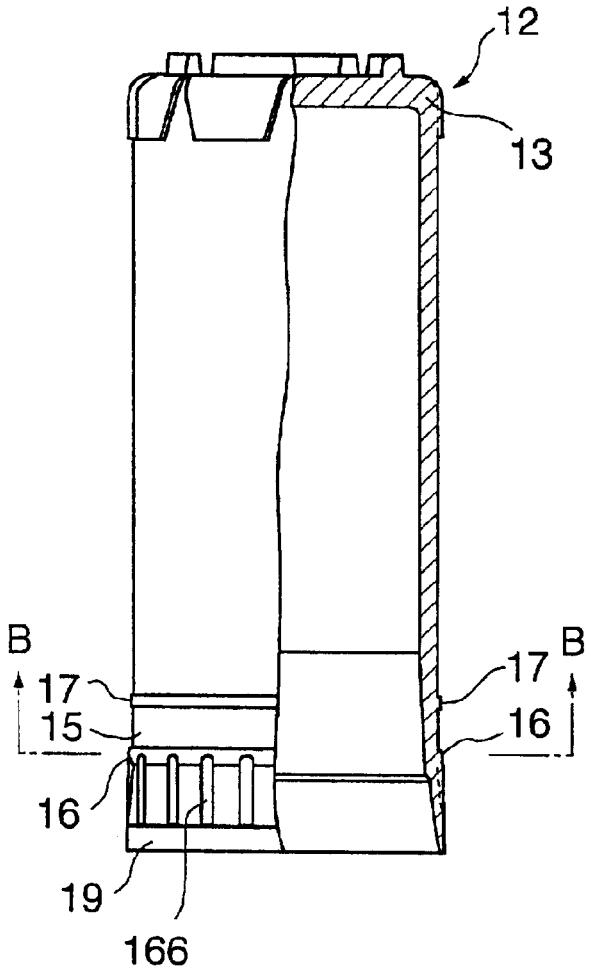
FIG. 16(A) is a front view thereof which is partly cut away to be shown in a vertical cross-section and FIG. 16(B) is a horizontal cross-section taken along B—B line in FIG. 16(A)
Figure 16B:
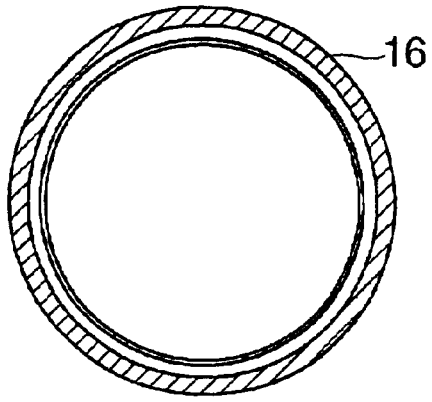
Figure 17A:
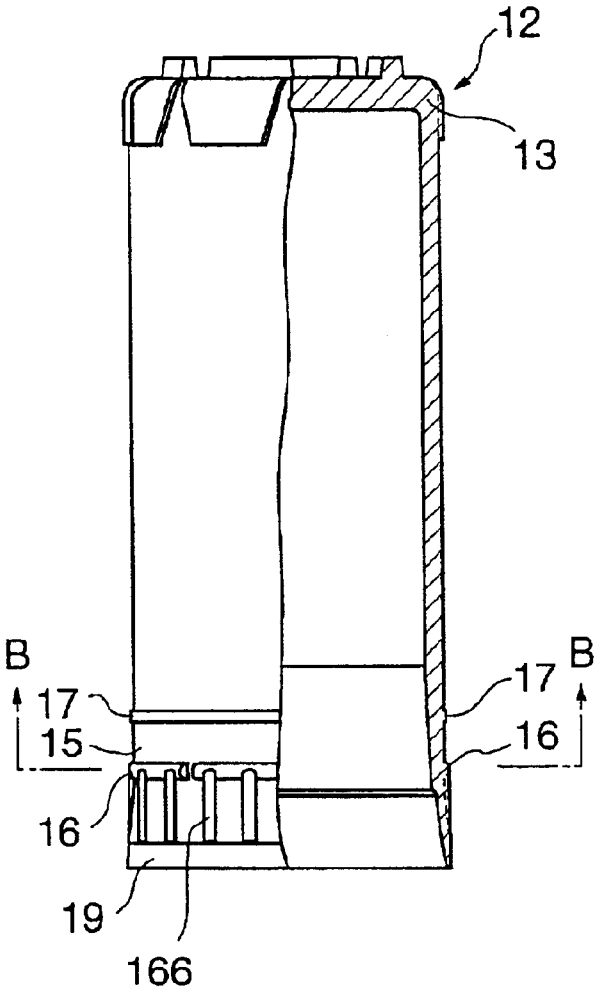
FIG. 17(A) is a front view thereof which is partly cut away to be shown in a vertical cross-section and FIG. 17(B) is a horizontal cross-section taken along B—B line in FIG. 17(A)
Figure 17B:
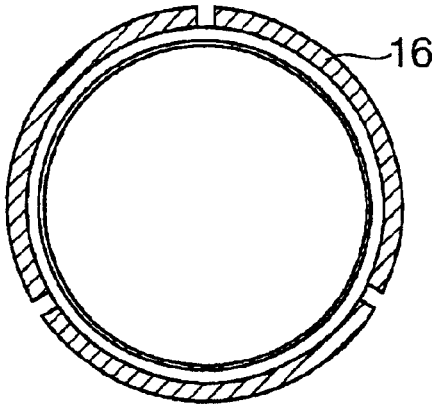
Figure 18A:
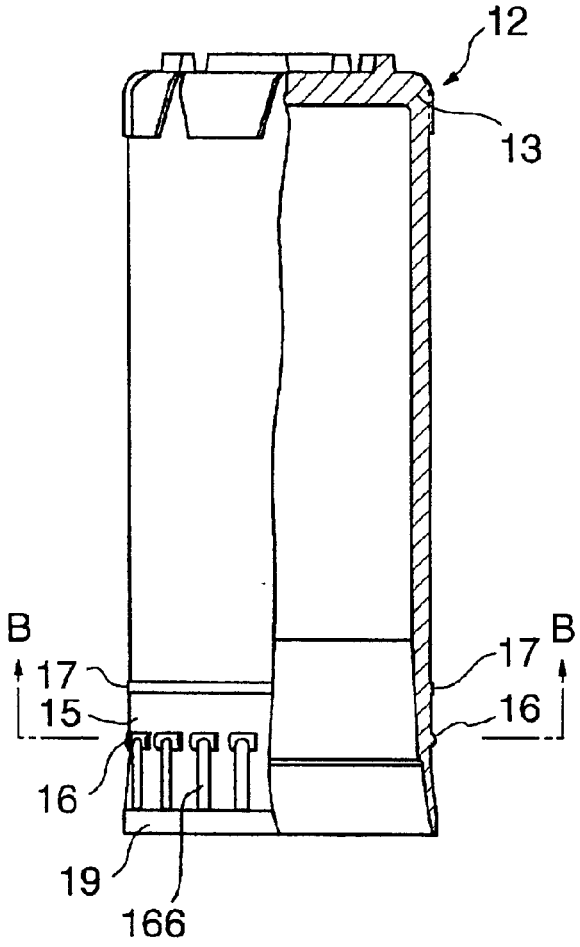
FIG. 18(A) is a front view thereof which is partly cut away to be shown in a vertical cross-section and FIG. 18(B) is a horizontal cross-section taken along B—B line in FIG. 18(A).
Figure 18B:
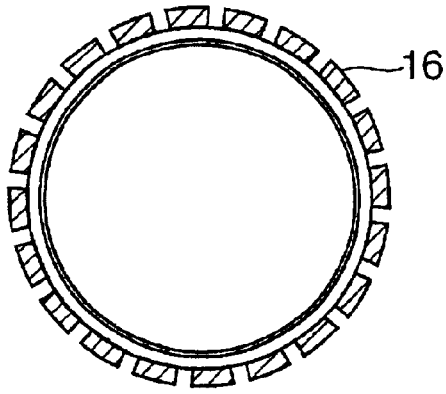

FIGS. 16–18 illustrate some examples according to a third embodiment of the present invention, wherein a plurality of spaced, axial or longitudinal protrusions 166 extend between a lower swell 16 formed as an endless continuous annular projection or ring of circular cross-section and a lower end 19 of inner cap member 12. Apart from the feature regarding axial protrusions 166, the third embodiment is similar to the second embodiment (FIG. 15).

FIGS. 17 and 18 illustrate examples modified from the example of FIG. 16. In a modification of FIG. 17, lower swell 16 comprises three spaced annular projections. In a modification of FIG. 18, lower swell 16 comprises a plurality of spaced annular segmental projections, each being connected to one of axial protrusions 166.

The third embodiment of the present invention have the same advantages and functions as having been described in connection with first and second embodiments. Due to axial protrusions 166 extending downward from lower swell 16, engagement of cap 11 with main body 1 may be maintained even if lower swell 16 do not have a sufficient axial length, which prevents inadvertent separation of cap 11 from main body 1 and further improves air-tightness of container 10. When lower swell 16 is formed as a continuous annular projection, once cap 11 is fitted, inner cap member 12 will readily be returned to its original configuration, which provides an improved air-tightness of container 10. When lower swell 16 is formed as a series of spaced annular segmental projections, inner cap member 12 is easy to be enlarged during capping operation.

Although preferred embodiments of the present invention have been described in detail in reference to the accompanying drawings, it is to be understood that many further variations and modifications may be made without departing from spirits and scopes of the present invention as defined in the appended claims. For example, when lower swell 16 is formed as a series of spaced annular segmental projections, the number of segmental projections may vary as desired. Segmentation may be made equally or unequally. Each segmental projection may have different length and/or cross-section. Likewise, the number, height and arrangement of semi-spherical projections 162 or connecting ribs 163 may be determined in a wide variety of option. In the examples of FIGS. 6–10, either one or both of upper and lower auxiliary ribs 164 may be omitted.

Although lower swell 16 and upper swell 17 of inner cap member 12 may have any desired axial cross-section, they preferably have a rectangular cross-section because it provides wider contact area with the inner surface of cap 11, which further improves air-tightness of container 10.

Elastic portion 15 may have different shape and thickness as far as it provide sufficient elasticity for deformation when cap 11 is inserted to main body 1. In a modified example, elastic portion 15 may have a uniform thickness, rather than having a thinned middle portion as shown in the illustrated embodiments. Elastic portion 15 may be thicker than upper swell 17. Axial protrusions 166 may extend downwardly from lower swell 16 in the first embodiment.

Inner cap member 12 may have any desired shape, as far as it has elastic portion 15 between upper swell 17 and lower swell 16. For example, a portion above upper swell 17 of inner cap member 12 may be inwardly thickened. In this embodiment, the inwardly thickened portion comes into contact with the upper end of insert sleeve 7 in a capped condition, thereby further improving air-tightness of container 10. In another embodiment, a lower end portion of inner cap member 12 is thinned, which facilitates engagement of cap 11 with main body 1.

The shape of ridge 8 of inner sleeve 7 is optional. The number of ridge 8 may be determined as desired. Ridge 8 may comprise an upper ridge and a lower ridge. In this embodiment, in a capped condition, the lower ridge engages with elastic portion 15 of inner cap member 12 whereas the upper ridge is positioned above upper swell 17. In other words, lower swell 16, lower ridge, upper swell 17 and upper ridge are arranged in a zigzag alignment, which provide favorable air-tightness of container 10.

The cosmetic container of the present invention is generally cylindrical but its shape, size and material is not limitative. The cosmetic container of the present invention is particularly used as a lipstick container but may be used for receiving any cosmetic material that is volatile or not.

In accordance with the cosmetic container of the present invention, it is possible to improve air-tightness of the container in a capped condition. Moreover, the cosmetic container of the present invention provides an improved air-tightness while assuring easy capping operation.

What is claimed is:

1. A cosmetic container comprising (i) a housing assembly with an annular external ridge and (ii) a cap assembly with an inner cap member engageable with said annular external ridge, wherein said inner cap member comprises:

an upper annular external swell;

a lower annular external swell; and a wall portion between the upper and lower annular external swells, wherein said wall portion is elastically deformable to provide air-tight engagement with said annular external ridge when said housing assembly is capped with said cap assembly, wherein said lower swell comprises a wavy periphery with tops and bottoms in radial cross-section and acts as a first stopper for preventing removal of said cap assembly from said housing assembly, and wherein said upper swell comprises an endless continuous ring and acts as a second stopper for preventing excessive insertion of said housing assembly into said cap assembly.

2. The cosmetic container according to claim 1, wherein said wavy peripheral cross-section of said lower swell comprises a continuous winding line wherein the tops and bottoms periodically alternate.

3. The cosmetic container according to claim 2, wherein the wavy periphery in radial cross-section of the lower swell includes at least one straight-extending segment.

4. The cosmetic container according to claim 1, wherein said wavy periphery of said lower swell is formed as a milled edge, and the tops and bottoms regularly repeat.

5. The cosmetic container according to claim 1, wherein said wavy periphery of said lower swell is formed as a series of arcs having a same diameter.

6. The cosmetic container according to claim 1, wherein at least one longitudinal projection is formed on an outer surface of said inner cap member so as to extend downward from said lower annular external swell to substantially a lower end of said inner cap member.

7. The cosmetic container according to claim 6, wherein at least one longitudinal projection extends from top portions of said wavy periphery of said lower swell.

8. The cosmetic container according to claim 6, wherein said at least one longitudinal projection extends from bottom portions of said wavy periphery of said lower swell.

* * * * *